US007513212B2

(12) United States Patent
Dvoracek

(10) Patent No.: US 7,513,212 B2
(45) Date of Patent: Apr. 7, 2009

(54) TRAFFIC CONE APPARATUS AND METHOD OF PRODUCTION

(76) Inventor: Joe Dvoracek, 430 N. Varney, Burbank, CA (US) 91502

( * ) Notice: Subject to any disclaimer, the term of this patent is extended or adjusted under 35 U.S.C. 154(b) by 0 days.

(21) Appl. No.: 11/485,850

(22) Filed: Jul. 12, 2006

(65) Prior Publication Data

US 2008/0011221 A1 Jan. 17, 2008

(51) Int. Cl.
*E01F 9/012* (2006.01)

(52) U.S. Cl. ..... 116/63 C

(58) Field of Classification Search ..... 116/63 C, 116/63 P; 40/612; 404/9, 10
See application file for complete search history.

(56) References Cited

U.S. PATENT DOCUMENTS

| | | | | | |
|---|---|---|---|---|---|
| 3,247,823 | A * | 4/1966 | Foster et al. | ..... | 116/63 R |
| 3,451,368 | A * | 6/1969 | Keats | ..... | 116/63 R |
| 3,596,628 | A * | 8/1971 | Wright | ..... | 116/63 P |
| 4,197,807 | A | 4/1980 | Campbell | | |
| 4,466,376 | A | 8/1984 | Wells | | |
| 4,925,334 | A | 5/1990 | Beard | | |
| 5,375,553 | A | 12/1994 | Chen | | |
| 5,421,668 | A * | 6/1995 | Cowan et al. | ..... | 404/6 |
| 5,713,694 | A * | 2/1998 | Monda et al. | ..... | 404/9 |
| 6,014,941 | A * | 1/2000 | Bent et al. | ..... | 116/63 R |
| 6,053,657 | A | 4/2000 | Signorelli | | |
| 6,305,312 | B1 * | 10/2001 | Bent et al. | ..... | 116/63 P |
| 6,929,419 | B1 * | 8/2005 | Kuo | ..... | 404/6 |
| 7,056,055 | B1 * | 6/2006 | Kuo | ..... | 404/9 |
| 2006/0016383 | A1 | 1/2006 | Flamingo et al. | | |
| 2007/0113774 | A1 * | 5/2007 | Kuo | ..... | 116/63 C |
| 2008/0011221 | A1 * | 1/2008 | Dvoracek | ..... | 116/63 C |

FOREIGN PATENT DOCUMENTS

| | | | |
|---|---|---|---|
| CA | 2257766 | A1 * | 8/1999 |
| GB | 2133065 | A * | 7/1984 |
| JP | 2003321815 | A * | 11/2003 |
| JP | 2005163312 | A * | 6/2005 |

* cited by examiner

*Primary Examiner*—R. A. Smith
(74) *Attorney, Agent, or Firm*—Gene Scott; Patent Law & Venture Group

(57) ABSTRACT

A traffic cone apparatus for controlling traffic has a molded base and a molded cone. The base is compression molded of bits of shredded tires into a preferably rectangular shape. The cone is co-injection molded with the base so as to engage the base with connector elements gripping apertures in the base.

8 Claims, 3 Drawing Sheets

TRAFFIC CONE APPARATUS AND METHOD OF PRODUCTION

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to traffic control apparatus and more particularly to a traffic cone made of two parts, a base of compressed tire fragments and a cone made of a plastic material or plastersol co-molded with the base such that the cone is mechanically engaged with the base.

2. Description of Related Art Including Information Disclosed under 37 CFR 1.97 and 1.98

Flamingo et al, 20060016383, discloses a traffic cone system including a base, a sleeve, and a retainer. The retainer substantially secures the sleeve relative to the base. A member such as a spring may be inserted into the sleeve make the sleeve stand upright. The member may act in concert with the retainer to secure the sleeve relative to the base. The system may be used to refurbish damaged traffic cones or may otherwise be retrofitted to existing traffic cone components. The system may alternatively be used to build new cones.

Chen, U.S. Pat. No. 5,375,553, discloses a traffic cone and in particular one which includes a conical body having a top, a flexible bag having an upper mouth, an annular member mounted on the mouth of the flexible bag and having an outer wall and an inner wall between which there is a recessed wall portion adapted to engage the top of the conical body, whereby the flexible bag may be expanded in the conical body to receive water, sand, earth, rock, or the like, so as to enable the conical body to stand firmly on the ground when in use and the traffic cone may be piled up on another one when not in use.

Signorelli, U.S. Pat. No. 6,053,657, discloses a safety or traffic marker capable of providing a continuous physical border between two locations. A housing, or one of several adapters, are employed in a conventional traffic cone to dispense an elongated strip of tape therefrom. In one embodiment, the housing is physically incorporated into the interior of the marker, and is adapted for easy insertion and removal of a tape or safety material dispenser. In order to achieve easy insertion of the tape dispenser into the housing, the upper portion of the marker is split into separable sections. Since the marker is fabricated from a deformable material, the upper portion can be manually separated into an opened position for insertion of the tape dispenser therein. Hook and loop fasteners may be used to fasten together the two sections into a closed position. Adapters may also be used in conjunction with conventional traffic markers for creating a continuous physical border between two or more locations.

Beard, U.S. Pat. No. 4,925,334, discloses a traffic marker including an upright cone-shaped member and a base. Two orifices are provided on the upper end of the cone-shaped member and on opposite sides thereof. A bracket is provided having an interior portion and an exterior portion. The bracket is operable to be inserted through the orifice such that the distal end of the interior portion contacts the interior surface of the cone-shaped member at a point. An orifice is disposed in the interior member through which a flag can be inserted. The flag is inserted through the orifice on the opposite side of the cone-shape member through the orifice to contact the opposite sides of the interior surface of the cone at a point.

Wells, U.S. Pat. No. 4,466,376, discloses a foldable traffic warning cone utilizing a first panel of generally fan shape having triangular faces joined at adjacent sides along face folding lines. The first panel has opposite free sides which interconnect to fold the first panel into an upright polygon. The triangular faces of the first panel have bottom ends with extending flaps which cooperate with a second panel having a number of sides commensurate to the number of faces on the first panel and which forms a base for the first panel. The second panel has wings extending outwardly from each of the sides and which are foldable to provide a wall extending about the base. The wings also trap the flaps and thereby connect the upright polygon and the base together. The warning cone can be selectively folded and unfolded for use and storage.

Cambell, U.S. Pat. No. 4,197,807, discloses a collapsible traffic cone marker characterized by a cylindrical base portion having one open face, an upwardly extending spiral reflective marker capable of collapsing and nesting within the base portion, and a bolt mechanism which can retain the spiral reflector within the casing when actuated or when released can allow the spiral spring to extend upwardly thereby approximating a conventional conical traffic marker.

The related art described above discloses various traffic cone devices. However, the prior art fails to disclose a traffic cone fabricated by co-injection or flow coating of a cone upper portion with a precise or molded base portion. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

A traffic cone is a challenge to manufacture economically. The traffic cone must have a relatively heavy base portion to provide stability in high winds and to resist movement on a paved or dirt surface when water flows are present. On the other hand, the traffic cone must have a highly flexible yet durable cone shaped portion to resist being damaged when run-over by a vehicle. In this instance, the cone portion must deform without damage to the vehicle's tire or itself and pop up to its original shape when the vehicle has past. The base must also be highly resilient so as to prevent damage to tires of passing vehicles. Clearly, the upper cone portion must have significantly different engineering characteristics than the base portion. The base must be resilient and heavy, which means that it must be made of a rubber-like material and must have significant thickness to provide the necessary heft. In contrast, the upper cone portion must be of a light weight material with some elasticity and significant resilient deformation capacity. Therefore, ideally these two portions should be made of different materials and yet must be permanently joined. The perfect solution is to make the base first and then co-mold the cone portion with portions of the cone molding interconnected with the base.

The presently described and illustrated traffic cone apparatus has a compression molded base portion made of ground tire bits and an injection molded or flow coated cone portion co-molded with the completed base portion wherein the co-molding process joins the cone portion to the base portion mechanically. The base is compression molded of ground bits of shredded tires into a preferably rectangular shape having relatively high specific weight and low cost, while the co-molded upper cone portion is made of a highly flexible and light weight polymer. The cone is co-injection molded with the base so as to engage the base with connector elements gripping apertures in the base so that the two parts are inseparable.

A primary objective inherent in the above described apparatus and method of use is to provide advantages not taught by the prior art.

Another objective is to provide a traffic cone having high durability and yet produced at lowest cost.

A further objective is to produce a traffic cone using molding and co-molding techniques.

A still further objective is to produce such a traffic cone wherein its base is made of ground tire bits compression molded.

A yet further objective is to produce such a traffic cone wherein its upper cone shaped element is co-molded with the prior molded base in a manner that mechanically joins the two parts.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications to what is described herein without departing from its spirit and scope. Therefore, it must be understood that what is illustrated is set forth only for the purposes of example and that it should not be taken as a limitation in the scope of the present apparatus and method of use.

Described now in detail is an apparatus for traffic control capable of resting on a traffic surface 5 (FIG. 5) such as a roadway, a parking lot surface, a street surface and the like. The apparatus is generally referred to as a "traffic cone" and is used, usually in a plurality, for directing vehicular traffic, especially when no permanent traffic control devices are available or when it is desired to change the paths of vehicles in contradiction to existing traffic control devices such as painted lane markers.

Figures 1, 2:
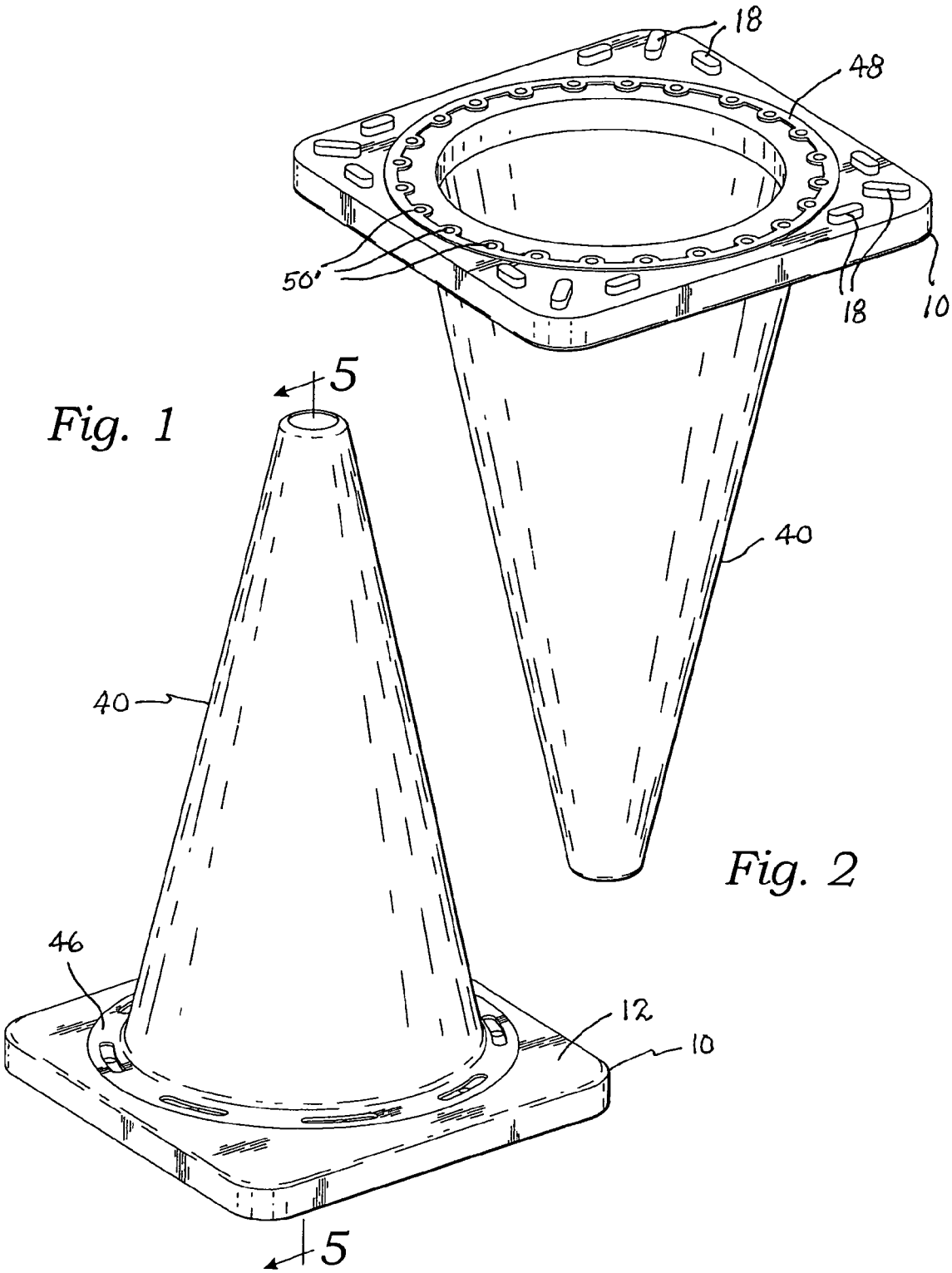
FIG. 1 is a perspective view of a first embodiment of the presently described apparatus as seen from above.
FIG. 2 is a further perspective view thereof with the apparatus inverted for exhibiting details not visible in FIG. 1.

The present apparatus is manufactured and constructed as the marriage of two essential elements: a base 10 and a cone 40. The base 10 is compression molded from bits of discarded (worn out or defective) tires which have been shredded and-or ground up into tiny bits. The compression molding process forces the bits into a mold along with a bonding compound and under high pressure and high temperature, the bits of tire are joined as a fully integrated and shaped part. This process is well known in the art. In the finished part, the bits are no longer able to be identified as they have become homogeneous in the forming process. In the present invention, the base 10 is preferably formed into a preferably rectangular shape having a top surface 12 with a well 14 formed therein, the well being critical to establish lateral stability to the cone 40. A bottom surface 16 provides outwardly (downwardly) protruding standoffs or feet 18. The standoffs 18 are adapted by shape, placement, and size, shown in FIGS. 2 and 4, for resting the apparatus on the traffic surface 5 in a stable manner while raising the bottom surface 16 above the traffic surface 5 so that the base 10 minimally impedes the flow of water that may be directed at the base 10, a common occurrence when "traffic cones" are used in a road construction site or during heavy rains. The base 10 is further configured with a plurality of apertures, referred to herein generally with the numeral 20, and which extend from the top surface 12 to the bottom surface 16 as will be described further in detail.

Figure 6:
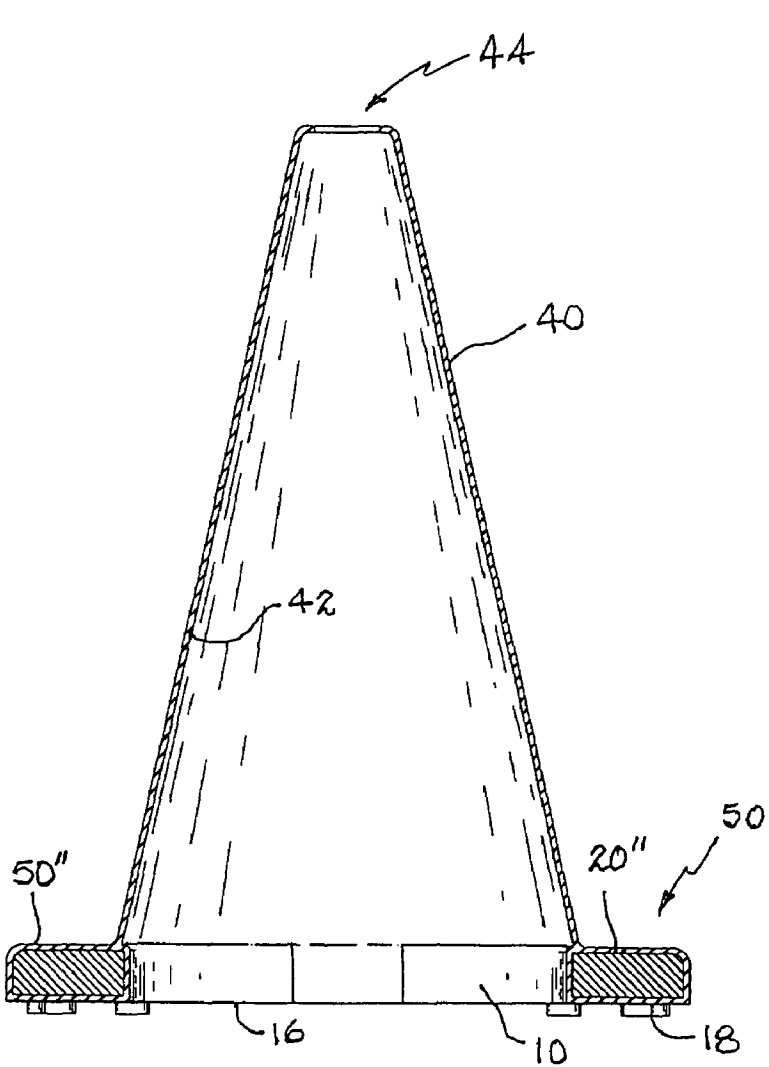
FIG. 6 is a vertical section of the second embodiment taken along lines 6-6 in FIG. 3.

The cone 40 is an injection molded right circular hollow cone defining an upright wall 42. The wall 42 terminates upwardly with an apex 44 and downwardly with an annular flange 46 which sits within the well 14 of the base 10. This configuration and arrangement is clearly shown in FIGS. 1, 2 and 5 in a first embodiment, and FIGS. 3, 4 and 6 in a second alternate embodiment.

In both the first and the second embodiments, a plurality of injection molded connectors referred to generally with numeral 50 are integrally joined with the annular flange 46 and extend within the plurality of apertures 20 thereby mechanically engaging the cone 40 with the base 10.

Figure 5:
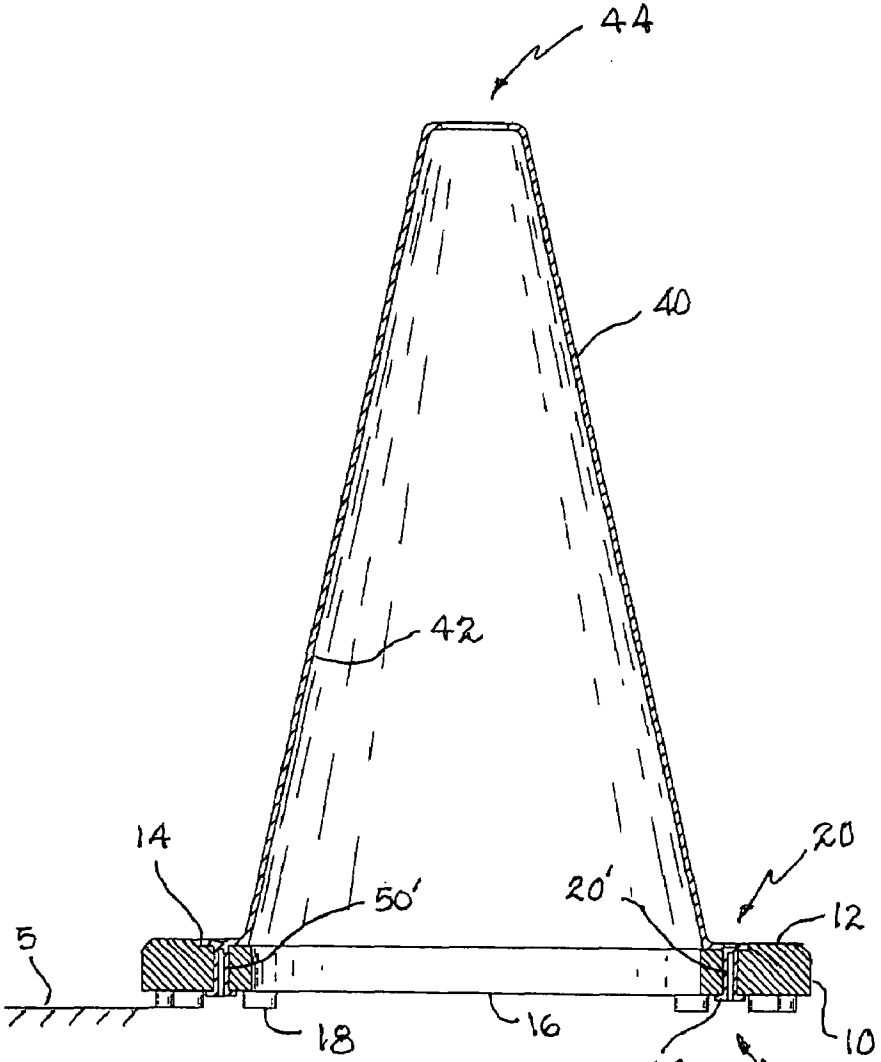
FIG. 5 is a vertical section of the first embodiment taken along lines 5-5 in FIG. 1.

In the first embodiment, the apertures form a circular arrangement of through holes 20' extending from the top surface 12 to the bottom surface 16, as best seen in FIG. 5. In this embodiment, the connectors 50 form a circular arrangement of plugs 50' integral with the annular flange 46 and extending within the through holes 20'. Preferably, the plugs 50' are collectively integral with a strip 48 which lies adjacent to the bottom surface 16 and acts to prevent the plugs 50' from pulling out of the holes 20' thereby mechanically securing the cone 40 with the base 10.

Figures 3, 4:
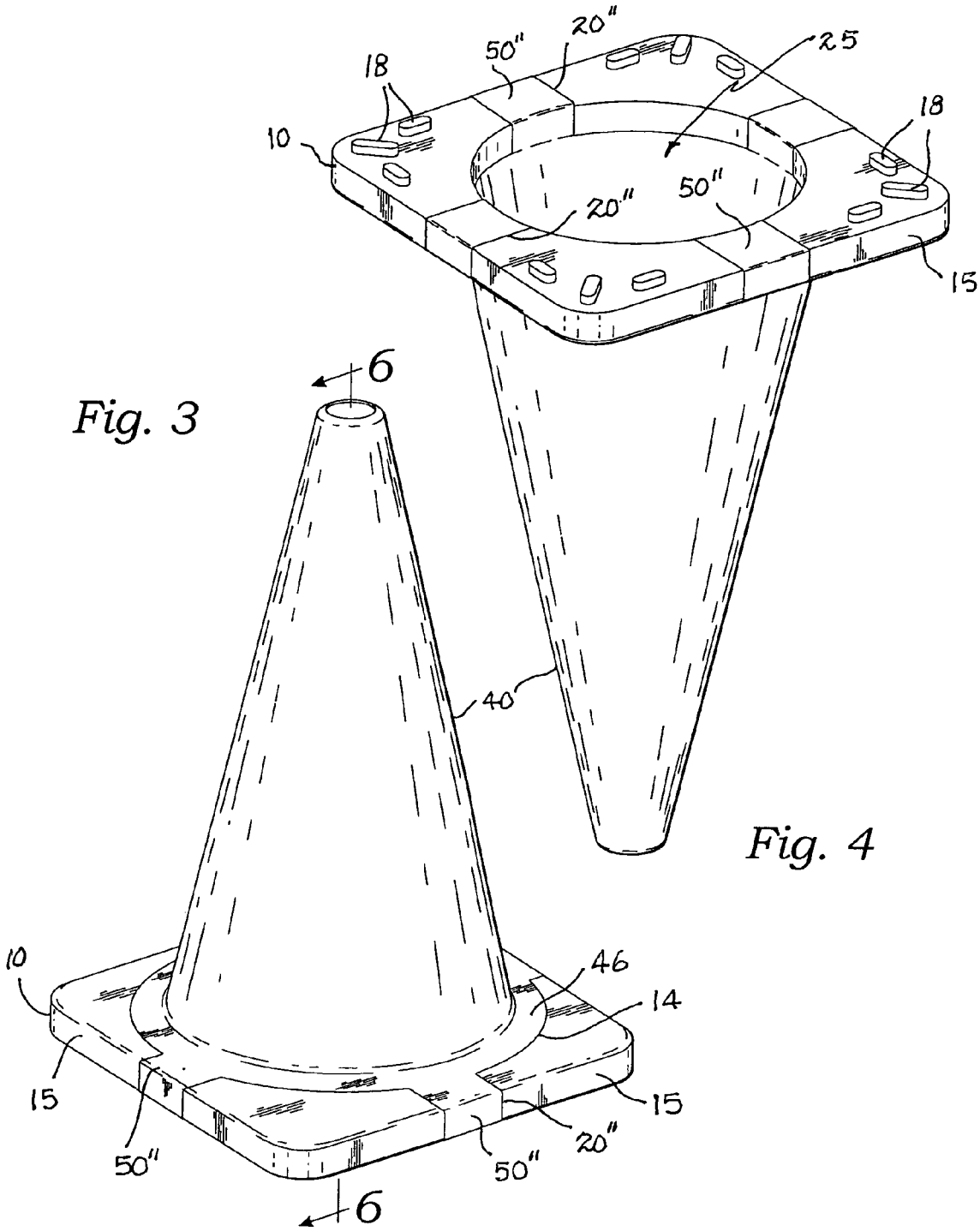
FIG. 3 is a perspective view of a second embodiment of the presently described apparatus as seen from above.
FIG. 4 is a further perspective view thereof with the apparatus inverted for exhibiting details not visible in FIG. 3.

In the second embodiment, the apertures are preferably grooves 20" as best seen in FIG. 3, extending from the well 14, across the top surface 14 and around side edges 15 of the base 10. In this embodiment, the connectors 50 are injection molded strips 50" extending within the grooves 20", around the side edges 15 of the base 10 and also through a central hole 25 in the base 10 and across the bottom surface 16 of the base 10 thereby encircling the base 10. Preferably, four such strips 50" are used and collectively are molded integrally with a cone 40 thereby mechanically securing the cone 40 with the base 10.

The usage of "apertures" herein is taken from the American Heritage Dictionary of the English Language, Third Edition, in its broadest sense of the word, i.e., "an opening such as a hole, gap, or slit." Under this definition, both the holes described in the first embodiment below, and the grooves described in the second embodiment are included as apertures. As well, any other embodiments wherein connector portions are formed simultaneously with the forming of the cone 40 and its flange 46 for capturing the cone 40 with the base 10 by engaging such apertures may be made.

The method of producing the above described traffic control apparatus comprises the steps of; first, compression molding the base 10 of bits of shredded tires forming the preferably rectangular shape having the top surface 12 with the well 14 formed therein, and the bottom surface 16 with the outwardly protruding standoffs 18. The base 10 is further configured with the plurality of apertures 20 as described. Next, the base 10 is placed within an injection mold cavity and the cone is injection molded (co-molded) with the base 10 in the form of the right circular, hollow, cone defining its upright wall 42, the wall terminating with its annular flange 46 sitting within the well 14 of the base 10. Co-molding of the type described herein is very well known in the art. At the same time that the cone 40 is being injection molded, the plurality of connectors 50 are integrally joined with the annular flange 46 and extended within the plurality of apertures 20 thereby mechanically engaging the cone 40 with the base 10. As described and shown, the apertures in the base 10 may be either the holes 20' or grooves 20" and the injection molded connectors are then formed as the plugs 50' along with strip 48, or strips 50" respectively with the base 10 providing some of the surfaces which conduct and limit the molten plastic during the co-molding process to form the plugs 50' and strips 50" as they are formed and molded.

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. A method of producing a traffic control apparatus capable of resting on a traffic surface, the method comprising the steps of:

a) forming a base having a hole therethrough;

b) forming a right circular, hollow, cone;

c) placing the cone in contact with the base; and d) joining the cone to the base by forming each of at least two connectors, integral with the cone, as an elongated strip extending from the cone around the base as a loop, including over a top surface, side edge, and bottom surface of the base, and an inside edge of the hole.

2. The method of claim 1 further comprising the step of forming a well in the top surface of the base and an annular flange depending from the cone, and inserting the flange into the well.

3. The method of claim 1 further comprising the step of forming outwardly protruding standoffs on the bottom surface of base, the standoffs adapted for resting on the traffic surface.

4. The method of claim 1 further comprising the step of forming the connectors in grooves within the base.

5. A traffic control apparatus capable for resting on a traffic surface, the apparatus comprising:

a base having a hole therethrough;

a right circular, hollow, cone; and at least two connectors, each connector integral with the cone and configured as an elongated strip extending from the cone around the base as a loop, including over a top surface, side edge, and bottom surface of the base, and an inside edge of the hole, thereby encircling the base and securing the cone to the base.

6. The apparatus of claim 5 further comprising a well in the top surface of the base and an annular flange depending from the cone, the flange inserted in the well.

7. The apparatus of claim 5 further comprising outwardly protruding standoffs on the bottom surface of base, the standoffs adapted for resting on the traffic surface.

8. The apparatus of claim 5 wherein the connectors are positioned in grooves within the base.

* * * * *